US010273915B2

(12) United States Patent
Saiga et al.

(10) Patent No.: US 10,273,915 B2
(45) Date of Patent: Apr. 30, 2019

(54) OUTBOARD MOTOR

(71) Applicant: SUZUKI MOTOR CORPORATION, Hamamatsu-shi, Shizuoka (JP)

(72) Inventors: Jiro Saiga, Hamamatsu (JP); Keisuke Daikoku, Hamamatsu (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 56 days.

(21) Appl. No.: 15/618,379

(22) Filed: Jun. 9, 2017

(65) Prior Publication Data

US 2017/0370334 A1 Dec. 28, 2017

(30) Foreign Application Priority Data

Jun. 22, 2016 (JP) ..... 2016-123635

(51) Int. Cl.

*B63H 20/00* (2006.01)
*B63H 20/32* (2006.01)
*F02B 61/04* (2006.01)
*F02M 35/16* (2006.01)

(52) U.S. Cl.

CPC ..... *F02M 35/168* (2013.01); *B63H 20/32* (2013.01); *B63H 20/001* (2013.01); *F02B 61/045* (2013.01)

(58) Field of Classification Search

CPC .... B63H 20/32; B63H 20/001; F02M 35/167; F02M 35/168; F02B 61/045
USPC ..... 440/76, 77, 88 A, 89 F
See application file for complete search history.

(56) References Cited

U.S. PATENT DOCUMENTS 5,340,343 A * 8/1994 Kawamukai ..... F02B 61/045 440/77
6,964,255 B2 * 11/2005 Shomura ..... F01P 3/202 123/198 E
7,021,979 B2 * 4/2006 Yazaki ..... B63H 20/00 440/77
8,851,945 B2 * 10/2014 Harada ..... F02B 61/045 440/77
9,017,122 B2 * 4/2015 Harada ..... F02M 35/10262 440/88 A
9,611,022 B2 * 4/2017 Matsumoto ..... B63H 20/32
2007/0093152 A1 4/2007 Ochiai

FOREIGN PATENT DOCUMENTS

JP 2007118648 A 5/2007

* cited by examiner

*Primary Examiner* — Ajay Vasudeva
(74) *Attorney, Agent, or Firm* — Troutman Sanders LLP

(57) ABSTRACT

Combustion air intake ports are provided on left and right side faces of an upper part of an engine cover. An outer louver is disposed to confront the combustion air intake port, and an inner louver is disposed inward of the outer louver at a predetermined interval to face the outer louver. The combustion air received from the combustion air intake port passes through the outer louver and the inner louver and is guided to the engine unit from the guide hole. In this case, a splash of water is dispersed in the outer louver, and a large-sized water droplet falls down due to its self-weight before the combustion air reaches the inner louver, so that a small-sized water droplet can be collected and removed using inertial impaction at the inner louver. Therefore, it is possible to effectively separate water.

15 Claims, 10 Drawing Sheets

OUTBOARD MOTOR

CROSS-REFERENCE TO RELATED APPLICATIONS

This application is based upon and claims the benefit of priority of the prior Japanese Patent Application No. 2016-123635, filed on Jun. 22, 2016, the entire contents of which are incorporated herein by reference.

BACKGROUND OF THE INVENTION

Field of the Invention

The present invention relates to an outboard motor in which combustion air received from a combustion air intake port is guided to an engine unit through a water separator.

Description of the Related Art

In a typical outboard motor, combustion air is guided to an engine unit through a water separator.

For example, Patent Document 1 discusses an outboard motor having a first water separator having an arc-shaped intake passage connected between a right intake port and a left intake port and a second water separator communicating with the first water separator through a communicating hole.

Patent Document 1: Japanese Laid-open Patent Publication No. 2007-118648

In the technique of Patent Document 1, the first or second water separator is incorporated into a part of the intake passage to provide an air-water separation capability based on gravity using a shape of the passage or a partition wall.

Here, for water separation of the outboard motor, a measure for water separation of rain or spray is prepared naturally. In addition, it is necessary to also consider water separation of a splash of water generated by dispersion of waves such as the heave or water separation for small-sized water drops such as mist. Unfortunately, the technique of Patent Document 1 fails to consider a measure for small-sized water drops such as a splash of water or mist.

In the technique of Patent Document 1, a water-repellent filter for separating water and air is also installed in the first, second, or third water separator. However, if the filter is employed, clogging is generated due to salts contained in seawater. Therefore, it is necessary to perform maintenance such as cleaning or replacement of the filter. This burdens a user with a work load or cost.

SUMMARY OF THE INVENTION

In view of the aforementioned problems, it is therefore an object of the present invention to provide an outboard motor having a water separation capability considering a measure for small-sized water drops such as a splash of water or mist as well.

According to an aspect of the present invention, there is provided an outboard motor including: a combustion air intake port provided in an engine cover that covers an engine unit as an internal combustion engine; and a water separator configured to separate water from combustion air received from the combustion air intake port, so that the combustion air received from the combustion air intake port is guided to the engine unit through the water separator, wherein the combustion air intake port is provided in a side face of an upper part of the engine cover, and the water separator has an outer louver disposed to confront the combustion air intake port and an inner louver disposed inward of the outer louver at a predetermined interval to face the outer louver.

DETAILED DESCRIPTION OF THE PREFERRED EMBODIMENTS

An outboard motor according to an embodiment of the invention includes a combustion air intake port provided in an engine cover that covers an engine unit as an internal combustion engine, and a water separator configured to separate water from combustion air received from the combustion air intake port, in which the combustion air received from the combustion air intake port passes through the water separator and is guided to the engine unit, wherein the combustion air intake port is provided in a side face of an upper part of the engine cover, and the water separator has an outer louver disposed to confront the combustion air intake port and an inner louver disposed inward of the outer louver at a predetermined interval to face the outer louver. In the outboard motor having such a configuration, a splash of water is dispersed in the outer louver. In addition, a large-sized water droplet falls down by its self-weight before the combustion air reaches the inner louver, and a small-sized water droplet can be collected and removed using inertial impaction in the inner louver, so that water can be effectively removed. The louver is formed by arranging a plurality of slats.

<Embodiment>

Preferred embodiments of the present invention will now be described with reference to the accompanying drawings.

Figure 1:
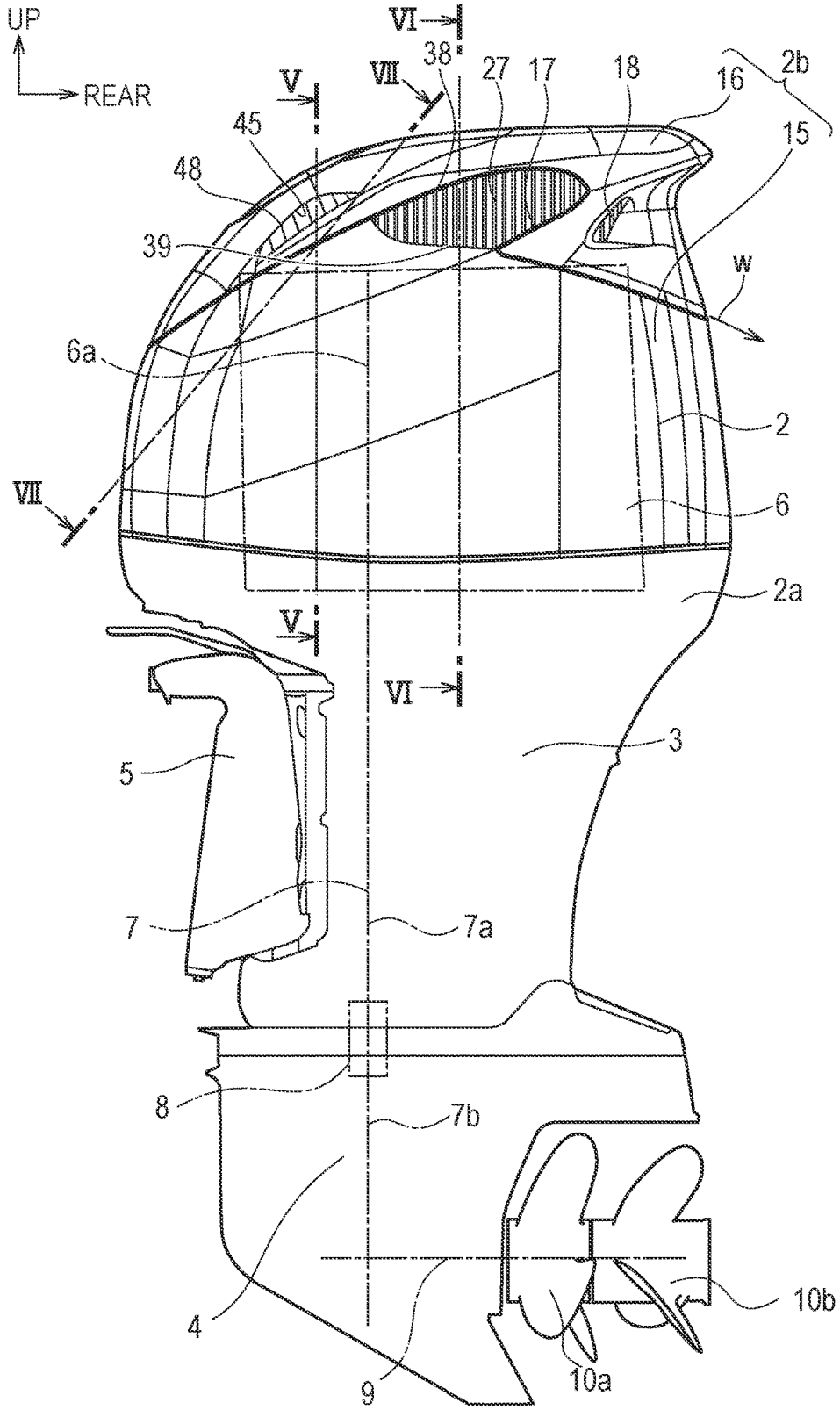
FIG. 1 is a left side view schematically illustrating an exemplary configuration of an outboard motor.

FIG. 1 is a left side view schematically illustrating an exemplary configuration of the outboard motor. Note that the front, rear, left, right, up, and down directions described herein refer to those set when the outboard motor 1 is mounted to a transom of a ship, and they will be indicated as necessary in each drawing.

A housing of the outboard motor 1 includes an engine housing 2, a drive shaft housing 3 provided under the engine housing 2, and a gear housing 4 provided under the drive shaft housing 3. The outboard motor 1 having such a configuration is mounted to a transom of a ship (not shown) using a bracket device 5 provided in a front part.

A drive system of the outboard motor 1 includes an engine unit 6 as an internal combustion engine, a drive shaft 7, a gearshift mechanism 8, a propeller shaft 9, and thrust propellers 10*a* and 10*b*.

The engine unit 6 is a driving force source of the outboard motor 1 and is housed in an engine room of the engine housing 2. The engine unit 6 is a vertical water-cooled V-type engine, in which an axis of the crankshaft 6*a* is aligned in a vertical direction, and left and right cylinder units (including cylinder blocks and cylinder heads) are directed backward and opened in a V-shape as seen in a plan view (refer to the one-dotted chain line 6*b* in FIG. 3).

The drive shaft 7 is disposed to extend vertically inside the drive shaft housing 3 and receives a rotational drive force of the engine unit 6. The drive shaft 7 has a first drive shaft 7*a* and a second drive shaft 7*b*.

The gearshift mechanism 8 performs control of connection or disconnection of the rotational drive force between the first and second drive shafts 7*a* and 7*b* and switching of the rotational direction.

The propeller shaft 9 is disposed to longitudinally extend inside the gear housing 4 to receive a rotational drive force from the engine unit 6 to the drive shaft 7 and transmit it to the thrust propellers 10*a* and 10*b*.

The thrust propeller includes a front thrust propeller 10*a* and a rear thrust propeller 10*b* so that the thrust propellers 10*a* and 10*b* constitute a contra-rotating propeller.

The engine housing 2 includes a lower cover 2*a* and an engine cover 2*b* detachably mounted to the top of the lower cover 2*a*.

Figure 2:
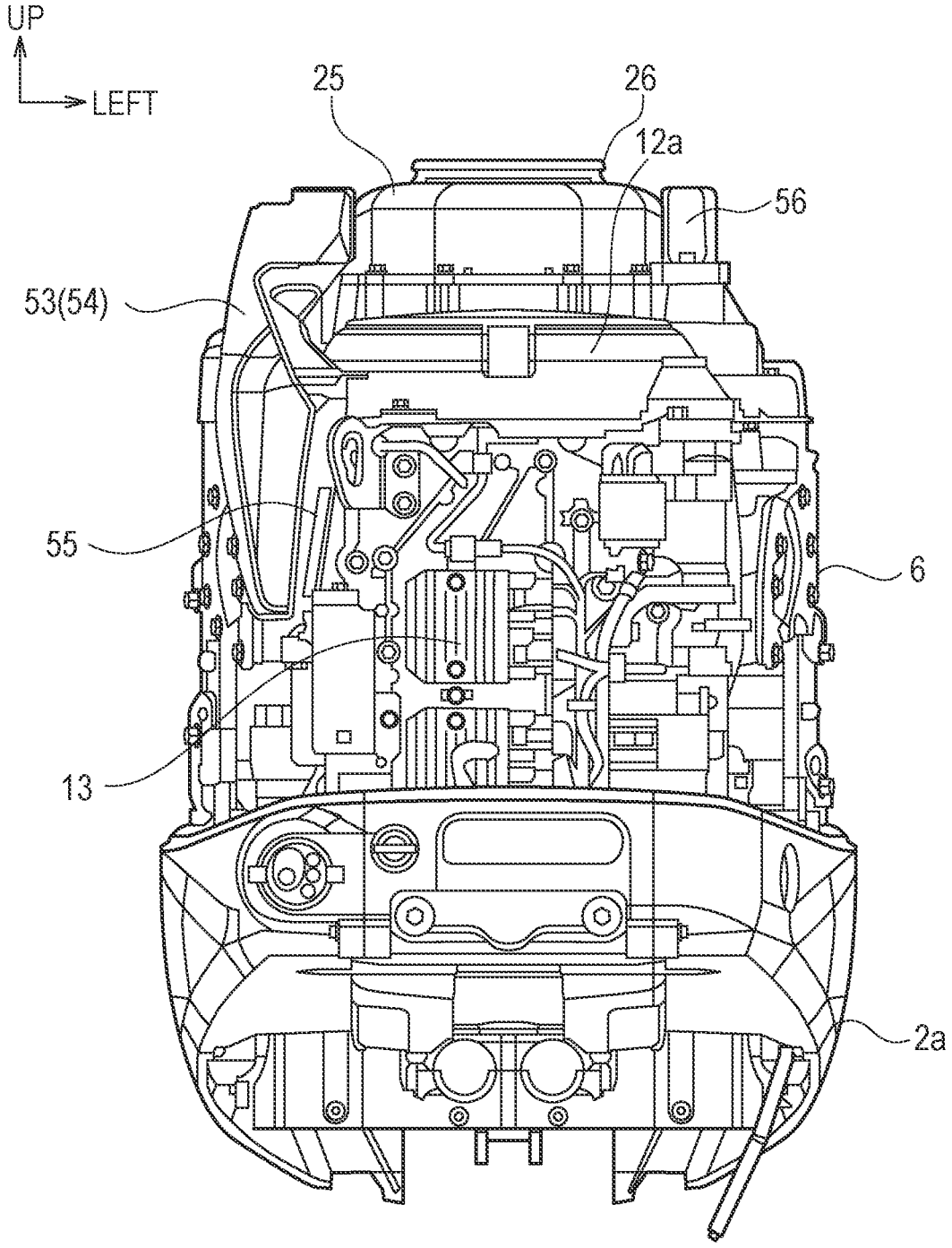
FIG. 2 is a front view illustrating main parts of the outboard motor when an engine cover is removed.
Figure 3:
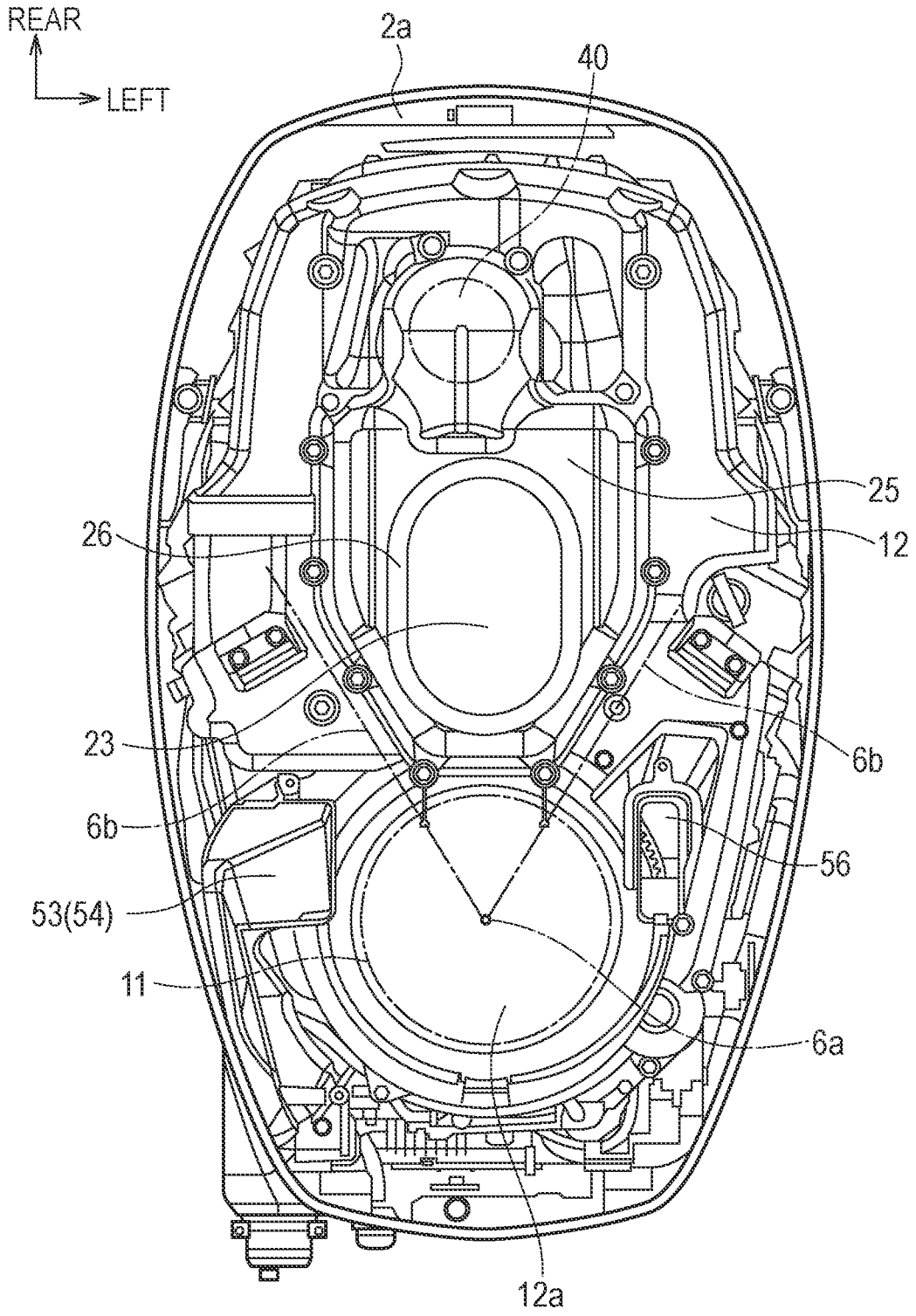
FIG. 3 is a top plan view illustrating main parts of the outboard motor when the engine cover is removed.
Figure 4:
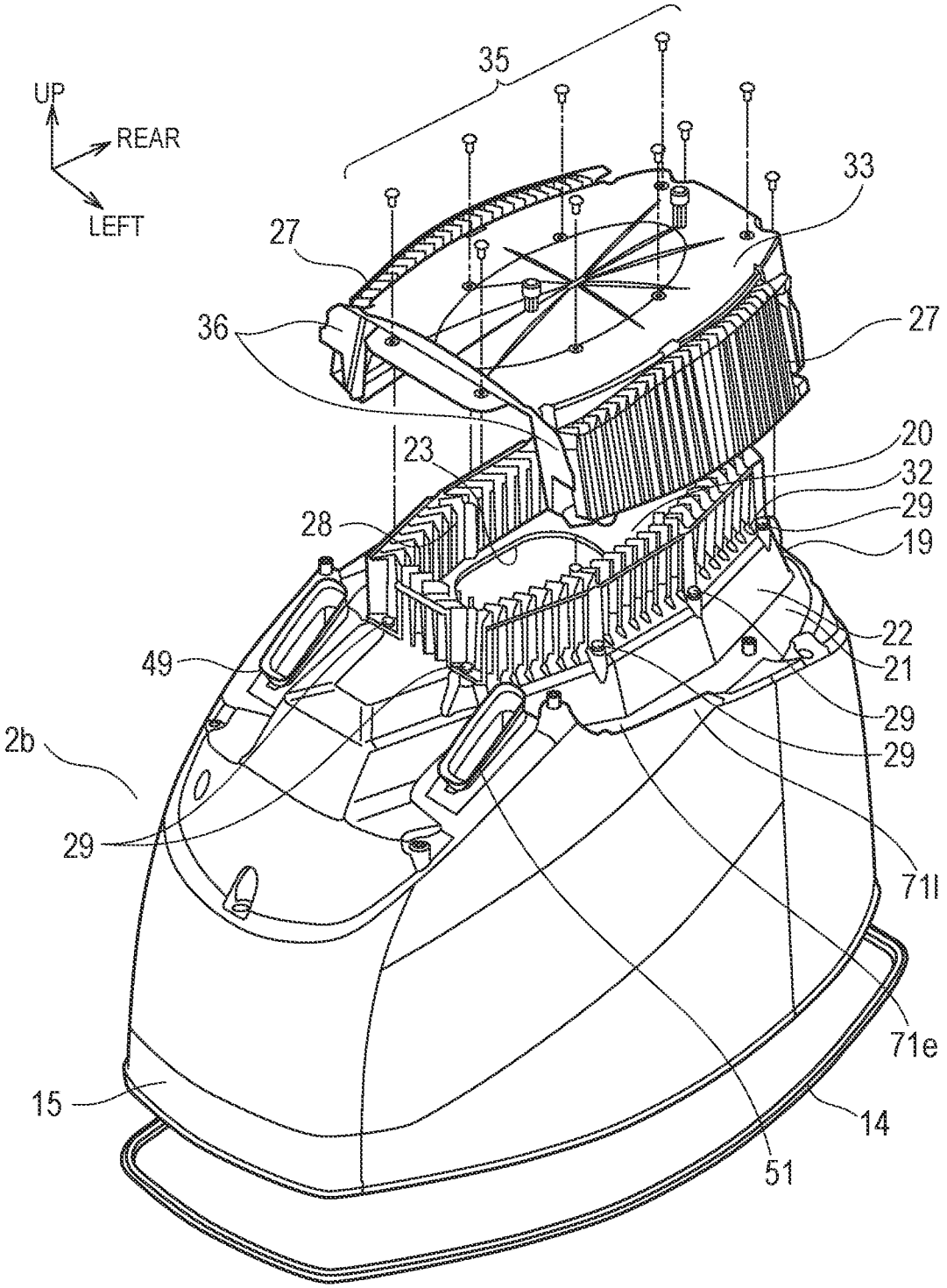
FIG. 4 is a perspective view illustrating an engine cover body of the engine cover.

In FIGS. 2 and 3, a state that the engine cover 2*b* is removed from the engine housing 2 is illustrated. In addition, FIG. 4 illustrates an engine cover body 15 of the engine cover 2*b*. Note that, although the ducts 53 and 56 are provided in the engine cover 2*b* as described below, they are intentionally shown for simplicity purposes in FIGS. 2 and 3.

On top of the crankshaft 6*a* of the engine unit 6, a flywheel 11 and a magnetogenerator (not shown) integrated into the flywheel 11 are provided. A cover 12 including a flywheel cover 12*a* is disposed over the engine unit 6. In addition, in a front part of the engine unit 6, a regulator 13 for controlling an electric current of the magnetogenerator is disposed.

As illustrated in FIG. 4, a weather strip 14 is installed along the entire circumference of the bottom of the engine cover 2*b* using an adhesive or the like. As a result, the engine cover 2*b* and the lower cover 2*a* are sealed, so that it is possible to prevent water from intruding the engine room.

<Combustion Air Intake Structure>

Figure 6:
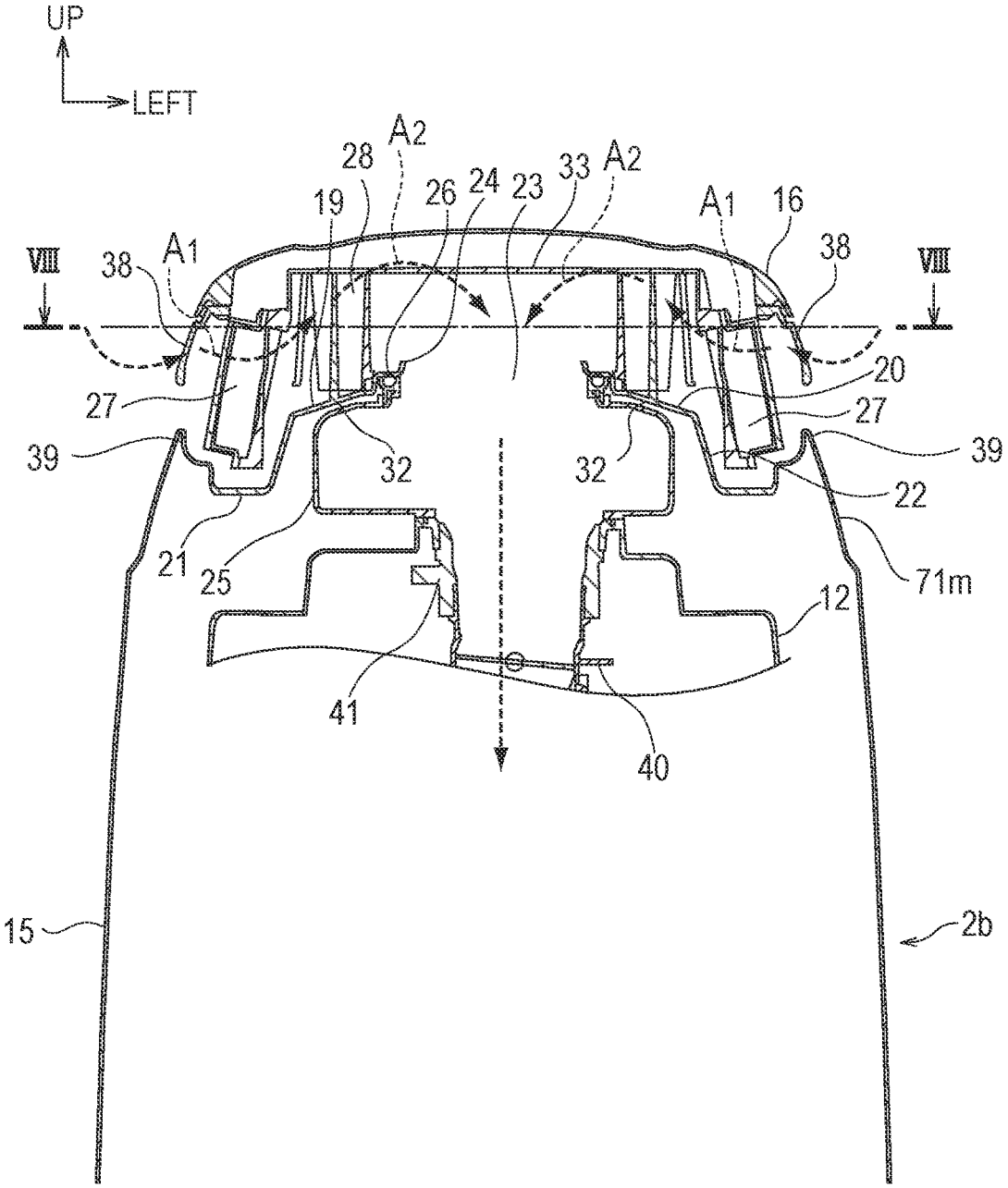
FIG. 6 is a cross-sectional view illustrating a schematic configuration taken along a line VI-VI of FIG. 1.
Figure 8:
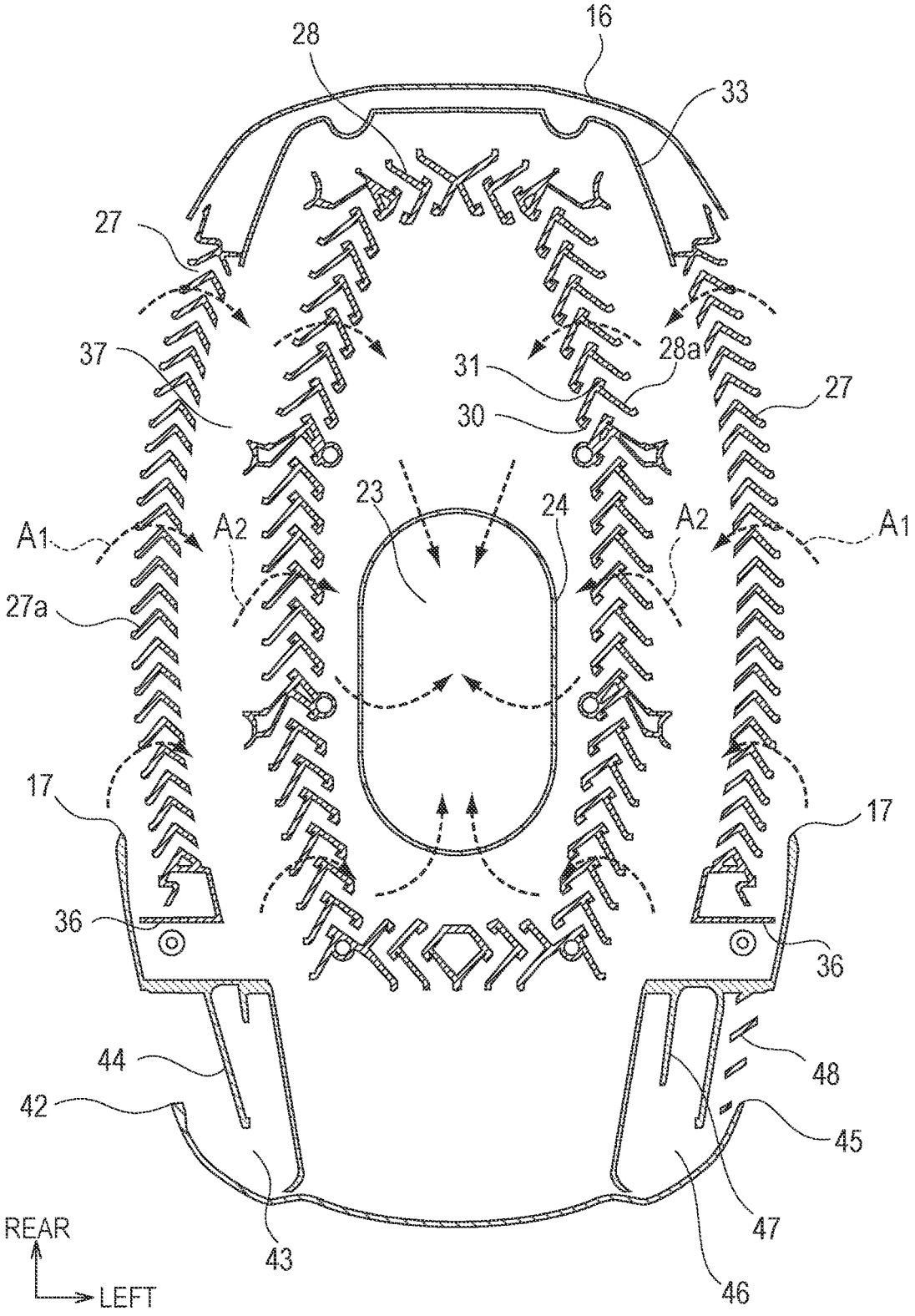
FIG. 8 is a cross-sectional view illustrating a schematic configuration taken along a line VIII-VIII of FIG. 6.

A combustion air intake structure of the outboard motor 1 will now be described. FIG. 6 is a cross-sectional view illustrating a schematic configuration taken along the line VI-VI of FIG. 1. In addition, FIG. 8 is a cross-sectional view illustrating a schematic configuration taken along the line VIII-VIII of FIG. 6. In FIGS. 6 and 8, a flow of the combustion air is indicated by a dotted arrow.

The engine cover 2*b* that covers the engine unit 6 includes an engine cover body 15 and a top cover 16 detachably installed in the upper part of the engine cover body 15.

Combustion air intake ports 17 opened to the outer face of the engine cover 2*b* are formed on the left and right side faces of the upper part of the engine cover 2*b*. The combustion air intake ports 17 are formed in boundaries between the engine cover body 15 and the top cover 16 and have a longitudinally long streamline shape along with the engine cover body 15 and the top cover 16. Note that the boundary between the engine cover body 15 and the top cover 16 is indicated by a bold line in FIG. 1. In addition, the top cover 16 is provided with a subsidiary combustion air intake port 18 placed in rear of the combustion air intake port 17.

As illustrated in FIG. 4, a center portion 20 swelling upward and trenches 21 formed in left and right sides of the center portion 20 are provided on a ceiling surface 19 of the engine cover body 15. The center portion 20 and the trenches 21 are continuously connected to each other with a slope surface 22 declining from the center portion 20 to the trenches 21.

The center portion 20 is provided with a guide hole 23 for guiding the combustion air and a wall 24 around the guide hole 23 (refer to FIG. 6). The guide hole 23 communicates with a resonance box 25 provided on the cover 12 over the engine unit 6. A seal 26 is provided around the guide hole 23 and around an upper opening of the resonance box 25. The guide hole 23 and the upper opening of the resonance box 25 are arranged approximately planar. Therefore, when the engine cover 2*b* is installed in the lower cover 2*a*, the seal 26 is pressed in a vertical direction (perpendicular to the plane), and it can be easily installed or removed. Therefore, it is possible to maintain hermeticity.

In the engine room, a throttle body 40 is disposed in a space between left and right cylinder portions opened in a V-shape as seen in a top plan view of the engine unit 6 and a rear side thereof (refer to FIG. 3), and a combustion air passage for guiding the combustion air to the throttle body 40 is formed. Specifically, as illustrated in FIG. 6, in the engine room, a combustion air passage including the resonance box 25, the cover 12, and the seal 41 is connected to the throttle body 40, and the guide hole 23 serves as an inlet of the combustion air passage.

As seen in a side view, the apical edges in the left and right sides of the engine cover body 15 have a backward declining shape, and the bottom surfaces of the trenches 21 have a backward declining slope. In addition, gaps are provided between the engine cover body 15 and the top cover 16 to match at least rear ends of the bottom surfaces of the trenches 21, so that water of the trenches 21 is discharged to the outside from the gap between the engine cover body 15 and the top cover 16 (refer to the arrow w in FIG. 1). In this case, for example, the lower end of the top cover 16 overlaps with the engine cover body 15 in the outer side to discharge water of the trenches 21 to the outside. However, preferably, water does not easily intrude from the outside.

In this regard, an outer louver 27 and an inner louver 28 are disposed inward of the top cover 16. The outer louver 27 is disposed to confront the combustion air intake port 17. In addition, the inner louver 28 is disposed inward of the outer louver 27 at a predetermined interval to face the outer louver 27. The combustion air received from the combustion air intake port 17 passes through the outer louver 27 and the inner louver 28 and is guide from the guide hole 23 to the engine unit 6 through the throttle body 40.

Figure 9A:
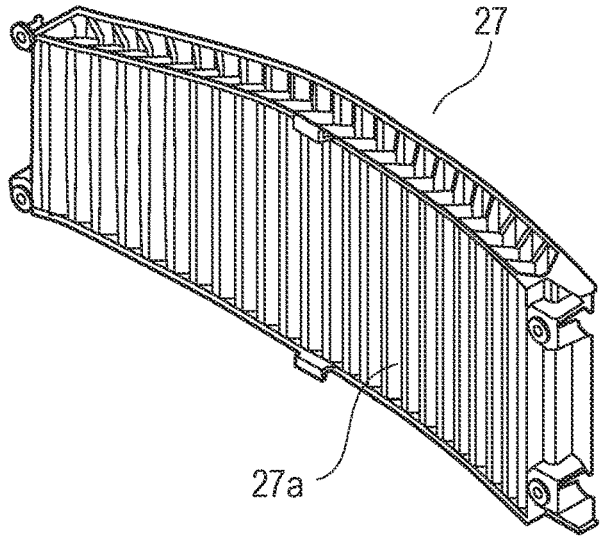
FIG. 9A is a perspective view illustrating an outer louver.
Figure 9B:
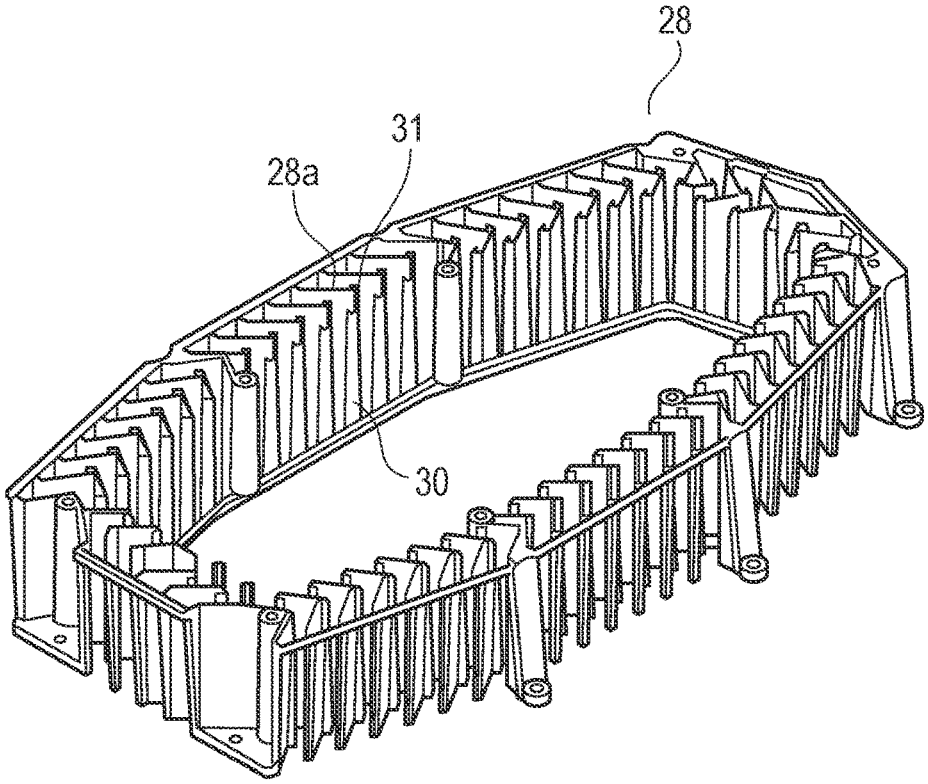
FIG. 9B is a perspective view illustrating an inner louver.

FIG. 9B illustrates an inner louver 28. The inner louver 28 is formed by arranging a plurality of slats 28*a* and is a vertical type louver in which the longitudinal direction of the slat 28*a* is set to the vertical direction. A horizontal louver in which the longitudinal direction of the slat is set to the horizontal direction may also be possible. However, in the horizontal louver, a water droplet falling down from any slat may be splashed on the edge of the lower slat. This may easily generate re-dispersion. In contrast, in the vertical louver, a water droplet collected on the slat flows down along the slat. Therefore, re-dispersion is not easily generated.

As illustrated in FIG. 4, the inner louver 28 is formed in a ring shape as seen in a top plan view. The inner louver 28 formed in this manner is fixed using screws 29 while the inner louver 28 is placed to surround the guide hole 23, and the ceiling surface 19 of the engine cover body 15 is placed on the center portion 20.

As illustrated in FIG. 8, the slat 28*a* of the inner louver 28 has a V-shape as seen in a cross-sectional plan view. The slats 28*a* in the left and right sides of the inner louver 28 having a ring shape are arranged in a V-shape opened to the front side. In addition, in the front side of the inner louver 28, the slats 28*a* are arranged in a V-shape opened inward. Furthermore, in the rear side of the inner louver 28, the slats 28*a* are arranged in a V-shape opened outward.

The inner edge of each slat 28*a* is provided with a gutter-like return section 30 extending in the vertical direction. By providing the return section 30, it is possible to reliably collect and guide a small-sized water droplet to flow down along the return section 30. Similarly, a peak of the bending portion of the V-shape of the slat 28*a* is provided with a gutter-like return section 31 extending in the vertical direction.

As illustrated in FIG. 6, the left and right ends of the center portion 20 are declined to the left and right sides and are connected to the slope surfaces 22. A plate-shaped joint portion 32 having the same cross-sectional shape as that of the slat 28*a* of the inner louver 28 is integrated into the left and right ends of the center portion 20, and the lower end of the slat 28*a* of the inner louver 28 is abuttingly connected to the joint portion 32. In this manner, the joint portion 32 and the slat 28*a* are erected from the ceiling surface 19 (center portion 20) of the engine cover body 15. If a gap is formed between the inner louver 28 and the ceiling surface 19, the combustion air containing water may directly flow from this gap to the guide hole 23. Therefore, it is possible to prevent such a failure. In addition, it is possible to allow the water droplet flowing down along the slat 28*a* to reliably reach the ceiling surface 19 and guide the water droplet from the left and right ends of the center portion 20 to the slope surface 22.

FIG. 9A illustrates an outer louver 27. The outer louver 27 has a plurality of slats 27*a* arranged side by side and is a vertical louver in which the longitudinal direction of the slat 27*a* is set to the vertical direction. As described above in conjunction with the inner louver 28, in the vertical louver, a water droplet collected on the slat flows down along the slat. Therefore, re-dispersion is not easily generated.

Figure 10:
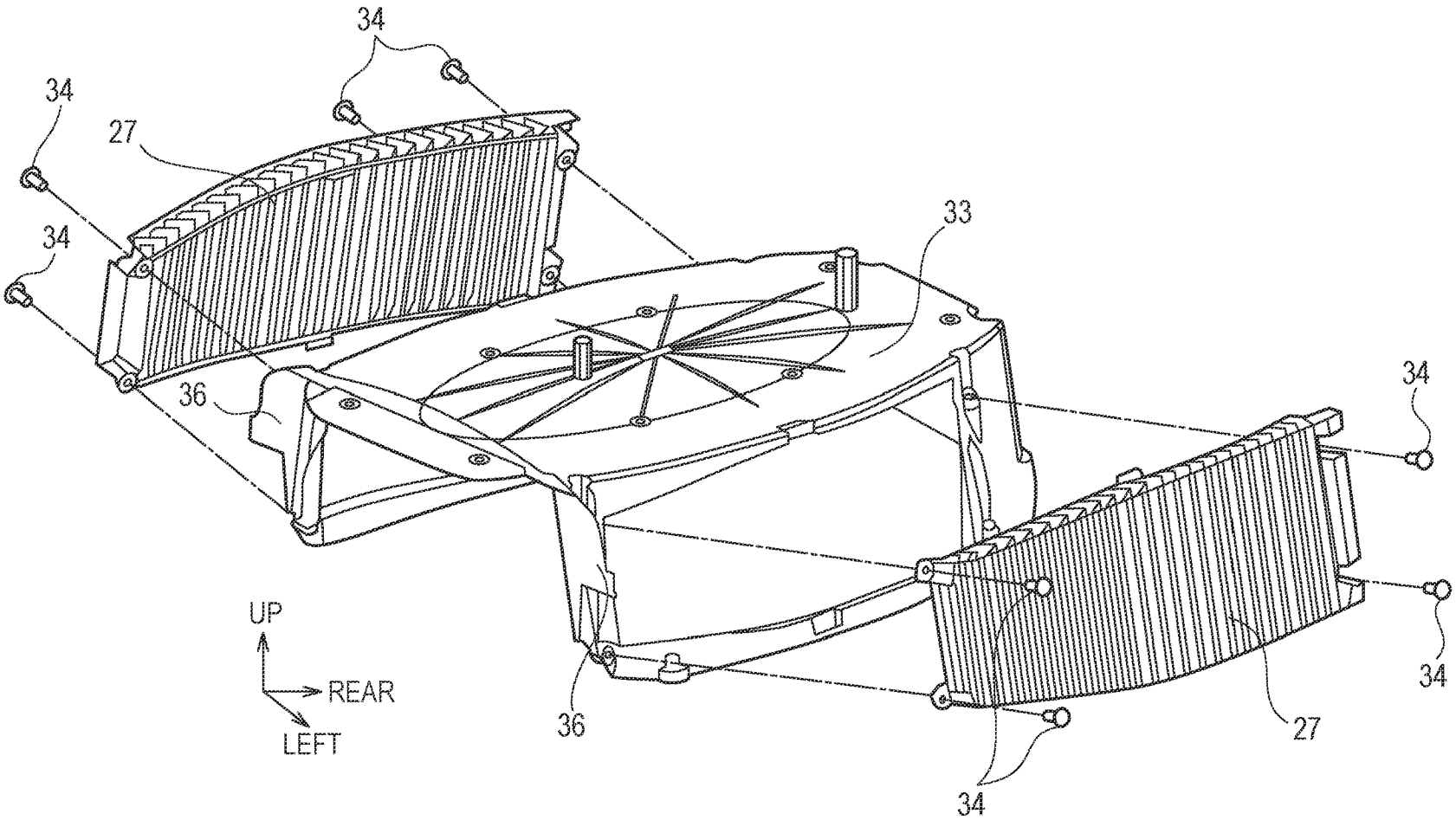
FIG. 10 is a perspective view illustrating an outer louver and a frame that supports the outer louver.

The outer louver 27 is paired with left and right outer louvers having a plate shape. As illustrated in FIG. 10, a pair of left and right outer louvers 27 are supported by the frame 33. The frame 33 has a box shape having a ceiling surface that blocks an upper opening of the inner louver 28, an opened front face, left and right side faces, and a closed rear face. The outer louvers 27 are fixed to the left and right side faces of the frame 33 with screws 34.

As illustrated in FIG. 4, the frame 33 is installed to cover the inner louver 28 and is fixed with screws 35. As a result, the left and right outer louvers 27 are arranged to face the left and right side faces of the inner louver 28 at a predetermined interval. In this state, the outer louver 27 is disposed over the trench 21 of the engine cover body 15, and a gap is secured between the lower end of the outer louver 27 and the ceiling surface 19 (bottom surface of the trench 21). In addition, the outer louvers 27 are disposed to be biased downward relative to the inner louver 28.

Extensions 36 extending vertically and outward are integrated into boundaries between the front face and the left and right side faces of the frame 33. An outer end shape of the extension 36 is mated with the inner shape of the ceiling surface of the top cover 16. As a result, as illustrated in FIG. 8, the inner louver 28 is surrounded by a surrounding space 37 serving as an independent chamber.

As illustrated in FIG. 8, the slat 27*a* of the outer louver 27 has a V-shape as seen in a cross-sectional plan view and is arranged in a V-shape opened to the front side.

Note that the slat 27*a* of the outer louver 27 is not provided with a return section unlike the inner louver 28. Since the outer louver 27 aims to disperse a splash of water as described below, the outer louver 27 does not necessitate the return section unlike the inner louver 28 that aims to collect and remove a small-sized water droplet. Since the return section is not provided, it is possible to reduce a pressure loss generated when the air passes through openings between the slats 27*a*.

As illustrated in FIG. 6, the outer louver 27 is placed inward of the combustion air intake port 17, that is, deeper than the outer face of the engine cover 2*b*. As illustrated in FIGS. 8 and 9A, the outer louver 27 has a plate shape generally curved to the inside and has an approximately constant distance from the combustion air intake port 17 to provide excellent designability. The top cover 16 is provided with a hood portion 38 disposed to overlap with the upper part of the outer louver 27 as seen in a side view. In addition, the engine cover body 15 is provided with a wall portion 39 disposed to overlap with the lower part of the outer louver 27 as seen in a side view. Even when a water membrane is formed along the top cover 16, the water does not directly flow to the outer louver 27 due to the hood portion 38 or the wall portion 39.

As described above, the water separator for separating water from the combustion air includes the outer louver 27 and the inner louver 28.

In forward operation of a ship, water mixed with the air received from the combustion air intake port 17 is predominantly rain or spray. This mixed air makes inertial impaction onto the left and right outer louvers 27 so that the water and the air are separated, and the air flows to the surrounding space 37 of the inner louver 28.

If a ship makes backward operation while waves are heaved, and a peak of the wave reaches the outboard motor 1, a splash of water generated by dispersed waves may rise to the height of the engine cover 2*b*. In this case, since the combustion air intake port 17 is not directed to the rear face of the engine cover 2*b*, a splash of water does not directly collide with the outer louver 27. However, the splash of water may flow from the rear face to the side face of the engine cover 2*b* in a winding manner. In this way, a splash of water turning to the side face of the engine cover 2*b* may intrude the combustion air intake port 17 and may intrude the surrounding space 37 of the inner louver 28 through the gap between the slats 27*a* of the outer louver 27 or the gap in the lower end of the outer louver 27. In this case, since the gap between the slats 27*a* of the outer louver 27 and the gap in the lower end of the outer louver 27 is small, the splash of water is dispersed into small-sized drops, and they fall down. The wave has periodicity, and a splash of water sloshes only at the peak of the wave. Therefore, the dispersed and falling-down small-sized drops are discharged to the outside flowing along the bottom surface of the trench 21 before the next wave arrives. In addition, as the wave amplitude is higher, the frequency is lower. Therefore, the water intruding the surrounding space 37 of the inner louver 28 is also discharged to the outside before the next wave arrives.

Since the larger water droplet has the faster falling velocity, it can be easily separated. In addition, since the inner louver 28 is disposed to be biased upward relative to the outer louver 27, a large-sized water droplet contained in the water mixed with the air flowing to the surrounding space 37 falls down due to its self-weight before it reaches the inner louver 28. Therefore, most of the water reaching the inner louver 28 has a predetermined particle size or smaller.

In this manner, if the air containing water having a predetermined particle size or smaller passes through the inner louver 28, it makes inertial impaction onto the inner louver 28, and the water is separated from the air. In the air-water separation based on the inertial impaction, minute water drops such as mist can be collected by appropriately setting the shape of the slat 28*a*. If the water droplet attached to the slat 28*a* grows on the slat 28*a* to a certain size, it naturally falls down along the slat 28*a* due to its self-weight. The water falling down along the slat 28*a* is guided from the slope surface 22 to the bottom surface of the trench 21 through the joint portion 32 and is discharged to the outside.

Here, the slat 27*a* of the outer louver 27 is disposed such that the V-shape is opened to the front side, that is, the peak of the bending portion is directed to the rear side. Since the slat 27*a* has a V-shape, a chance to collide with the combustion air containing water increases. Therefore, it is possible to improve water separation performance. In addition, the outer louvers 27 have slope surfaces inclining forward and outward in the side confronting the combustion air intake port 17. As a result, as indicated by the arrow A1 in FIG. 8, the air easily flows from the front side to the rear side. Therefore, it is possible to improve sailing performance (engine output power) during forward operation.

An interval between the neighboring slats 27*a* or a bending angle of the V-shape of the slat 27*a* may be appropriately set from the viewpoint of dispersion of a splash of water. For example, the bending angle of the V-shape of the slat 27*a* for dispersing a splash of water may be set to, approximately, 80 to 120°.

Note that, if the outer louver 27 is formed vertically symmetrically (symmetrical with respect to a horizontal line), it is possible to reduce the number of components by commonly using the components between the left and right sides. If the outer louver 27 is injection-molded from resin, and the mold is extracted from the inside and the outside along the slat 27*a*, the molding can be performed easily and inexpensively.

The slat 28*a* of the inner louver 28 is also disposed such that the slat 28*a* has a V-shape opened to the front side in the left and right sides, that is, a peak of the bending portion is directed to the rear side. Since the slat 28*a* has a V-shape, it is possible to increase a chance to collide with the combustion air containing water and improve water separation performance. In addition, the inner louver 28 has a slope surface inclining forward and outward in the side confronting the outer louver 27. As a result, as indicated by the arrow A2 in FIG. 8, the air easily flows from the front side to the rear side. Meanwhile, as indicated by the arrow A1 in FIG. 8, an air flow is generated from the rear side to the front side inside the outer louver 27. However, it is possible to prevent the air flow having such a direction from directly intruding the inner louver 28.

An interval between the neighboring slats 28*a* or a bending angle of the V-shape of the slat 28*a* may be appropriately set from the viewpoint of collecting and removing small-sized water droplets. For example, the bending angle of the slat 28*a* for collecting and removing small-sized water droplets may be set to, approximately, 60 to 100°.

Note that, in the resin injection molding, it is preferable to draw the mold of the slat 28*a* in the vertical direction by suppressing a change of the cross-sectional shape of the slat 28*a* in a draft gradient by lowering the height of the inner louver 28.

A predetermined interval between the outer louver 27 and the inner louver 28 is set to a sufficient large value such that a large-sized water droplet falls down by its self-weight before it reaches the inner louver 28, and a direction of the air flow can be changed (refer to the arrows A1 and A2 in FIG. 8). It is possible to reduce a pressure loss by changing a direction of the air flow reasonably. For example, the thickness of the outer louver 27 may be set to be equal to the thickness of the inner louver 28, and the interval may be set to the same value as this thickness or larger.

As described above, a splash of water is dispersed by the outer louver 27, and a large-sized water droplet falls down by its self-weight before the combustion air reaches the inner louver 28. As a result, it is possible to collect and remove a small-sized water droplet using inertial impaction onto the inner louver 28. Therefore, it is possible to effectively separate water.

Compared to the technique of the prior art discussed in Patent Document 1 in which a filter is used to separate water and air, maintenance such as cleaning or replacement is not necessary. Therefore, it does not burden a user with a work load or cost. In addition, since the outer louver 27 and the inner louver 28 are disposed inward of the detachable top cover 16, it is possible to easily assemble the outer louver 27 and the inner louver 28 and facilitate maintenance.

<Ventilation Structure of Engine Room>

Figure 5:
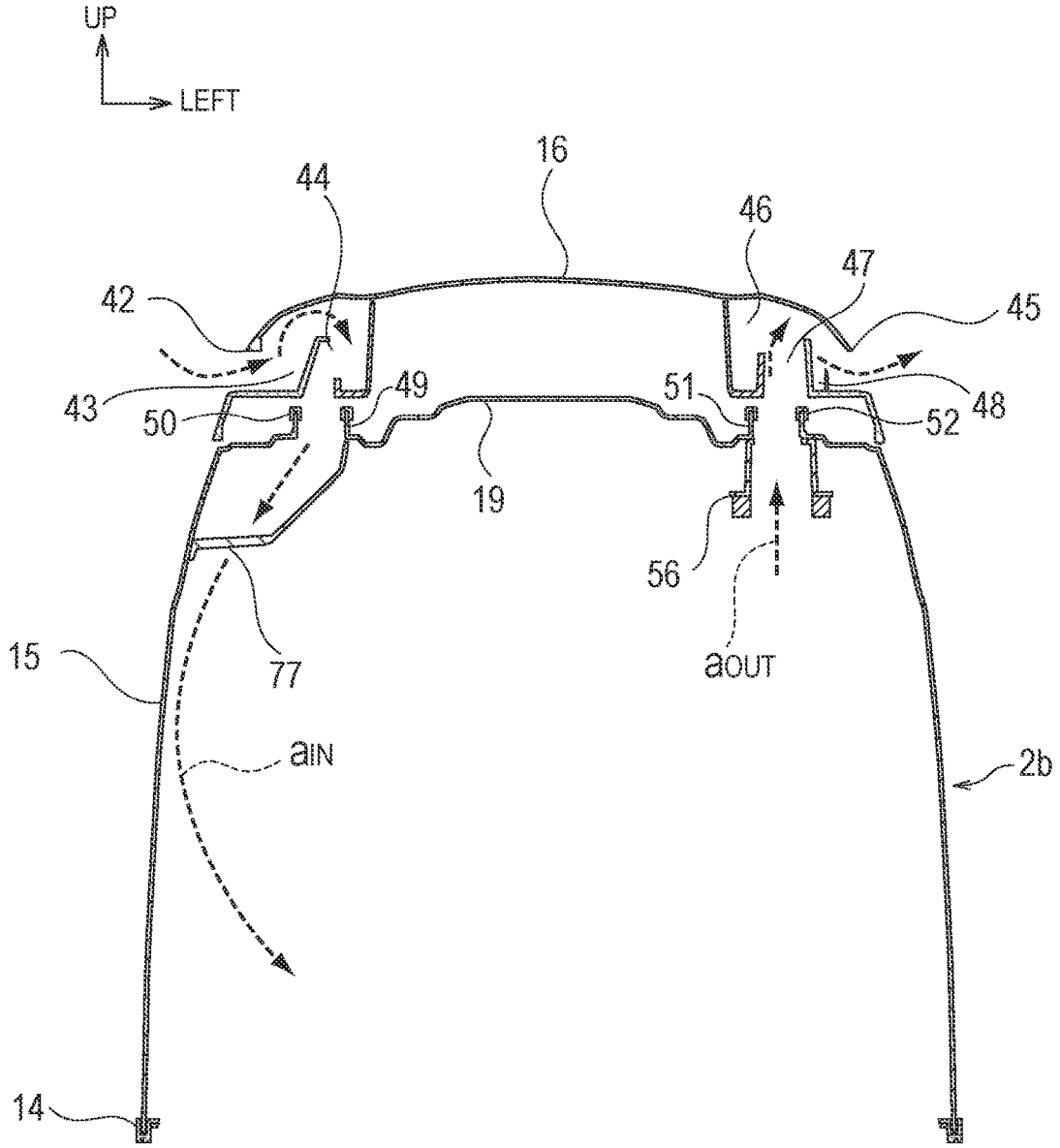
FIG. 5 is a cross-sectional view illustrating a schematic configuration taken along a line V-V of FIG. 1.
Figure 7:
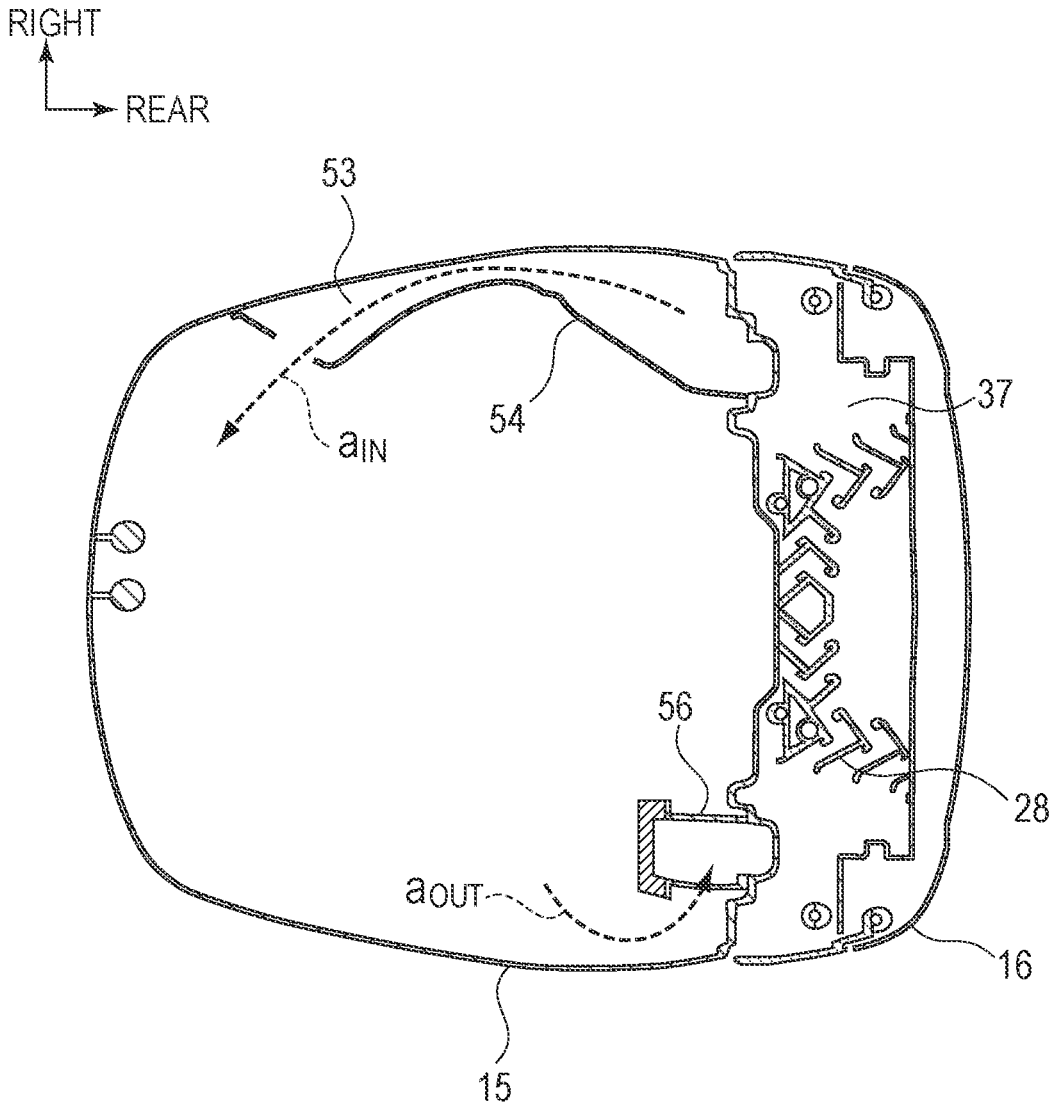
FIG. 7 is a cross-sectional view illustrating a schematic configuration taken along a line VII-VII of FIG. 1.

A ventilation structure of the engine room in the outboard motor 1 will now be described. FIG. 5 is a cross-sectional view illustrating a schematic configuration taken along the line V-V of FIG. 1. FIG. 7 is a cross-sectional view illustrating a schematic configuration taken along the line VII-VII of FIG. 1. In FIGS. 5 and 7, the ventilation air flow is indicated by the dotted arrow.

As illustrated in FIGS. 5 and 8, a ventilation air inlet duct 42 is formed in the right side face of the front part of the top cover 16. The ventilation air inlet duct 42 is disposed forward side with respect to the combustion air intake port 17. An inlet chamber 43 connected to the ventilation air inlet duct 42 is provided inward of the right side of the front part of the top cover 16, and a tubular hole 44 is provided on the bottom surface. The inlet chamber 43 is separated from the surrounding space 37 of the inner louver 28.

A ventilation air outlet duct 45 is formed in the left side face of the front part of the top cover 16. The ventilation air outlet duct 45 is placed forward side with respect to the combustion air intake port 17. An outlet chamber 46 connected to the ventilation air outlet duct 45 is provided inward of the left side of the front part of the top cover 16, and a tubular hole 47 is provided on the bottom surface.

The outlet chamber 46 is separated from the surrounding space 37 of the inner louver 28. The outlet chamber 46 is provided with a louver 48 to confront the ventilation air outlet duct 45. The louver 48 is a vertical louver and has a surface sloped backward and outward in the side confronting the ventilation air outlet duct 45. As a result, in forward operation of a ship, the air is ventilated to be caught in the air flow flowing along the lateral sides of the outboard motor 1. Therefore, it is possible to obtain effective ventilation. In addition, since ventilated warm air is discharged from the ventilation air outlet duct 45, the warm air is prevented from flowing into the combustion air intake port 17 by appropriately setting the air discharge direction using the louver 48. Furthermore, even when a user erroneously inserts his/her finger into the ventilation air outlet duct 45, the louver 48 serves as interference. Therefore, it is possible to prevent a user's finger from erroneously touching the high-temperature outlet chamber 46.

As illustrated in FIG. 4, a longitudinally long tubular inlet guide port 49 is provided in the front right part of the ceiling surface 19 of the engine cover body 15. As illustrated in FIG. 5, if the top cover 16 is mounted to the engine cover body 15, the tubular hole 47 in the right side of the top cover 16 is connected to the inlet guide port 49. Note that a seal 50 is interposed between the tubular hole 44 and the inlet guide port 49 to maintain hermeticity.

As illustrated in FIG. 4, a longitudinally long tubular outlet guide port 51 is provided in the front left part of the ceiling surface 19 of the engine cover body 15. As illustrated in FIG. 5, if the top cover 16 is mounted to the engine cover body 15, the tubular hole 44 in the left side of the top cover 16 is connected to the outlet guide port 51. Note that a seal 52 is interposed between the tubular hole 47 and the outlet guide port 51 to maintain hermeticity.

A duct 53 communicating with the inlet guide port 49 is provided inward of the front right part of the engine cover body 15. The inner surface of the engine cover body 15 and the duct member 54 constitute the duct 53 by fixing the duct member 54 having a box shape onto an inner surface of the engine cover body 15 using an adhesive or the like. The duct 53 extends to the vicinity of a vertical center of the engine room and is opened toward the front part of the engine unit 6 (refer to the opening 55 of FIG. 2). As a result, as indicated by the arrow $a_{IN}$ in FIGS. 5 and 7, the air received from the ventilation air inlet duct 42 is guided to the engine room through the inlet chamber 43, the tubular hole 44, the inlet guide port 49, and the duct 53 and is discharged to the front part of the engine unit 6 from the opening 55.

In the outboard motor, the engine unit 6 is cooled using seawater. Therefore, a radiation heat from the cylinder block or the cylinder head is insignificant. The magnetogenerator or the regulator 13 is more important as a heat source inside the engine room. In this regard, since the air received from the ventilation air inlet duct 42 is discharged to the front part of the engine unit 6, it is possible to prevent the heat from being stagnated in the vicinity of the front part of the engine unit 6 where the regulator 13 is arranged.

Meanwhile, a tubular duct 56 communicating with the outlet guide port 51 is provided inward of the front left part of the engine cover body 15. The duct 56 communicates with a flywheel cover 12. According to this embodiment, although not shown specifically, a fin is provided in the flywheel 11 to generate an air flow directed upward from the bottom of the engine room by virtue of rotation of the flywheel 11 during operation. As a result, as indicated by the arrow $a_{OUT}$ in FIGS. 5 and 7, the air inside the engine room is ventilated from the fin of the flywheel 11 and is discharged from the ventilation air outlet duct 45 through the duct 56, the outlet guide port 51, the tubular hole 47, and the outlet chamber 46.

As described above, the ventilation system is separated from the combustion air intake system. Specifically, a passage from the ventilation air inlet duct 42 to the engine room (including the inlet chamber 43, the tubular hole 44, the inlet guide port 49, and the duct 53) and a passage from the engine room to the ventilation air outlet duct 45 (including the duct 56, the outlet guide port 51, the tubular hole 47, and the outlet chamber 46) are separated from a passage guided from the combustion air intake port 17 through the outer and inner louvers 27 and 28 to the engine unit 6. As a result, it is possible to prevent the warm air inside the engine room from being mixed with the combustion air or prevent the air containing a lot of water from being mixed with the ventilation air.

Since the ventilation air inlet duct 42 and the ventilation air outlet duct 45 are disposed in the side faces of the front part of the engine cover 2*b* (top cover 16), the ventilation air inlet duct 42 and the ventilation air outlet duct 45 are not directly exposed to waves or heaves during backward operation.

Since even a small amount of the ventilation air can sufficiently work relatively to the combustion air, the size of the ventilation air inlet duct 42 may be reduced. As a result, a flow speed of the ventilation air is reduced, and air-water separation can be sufficiently obtained just by providing a water separation wall based on gravity similar to the tubular hole 44.

If water contained in the air received from the ventilation air inlet duct 42 is separated in the course of flowing through the inlet chamber 43, the tubular hole 44, the inlet guide port 49, and the duct 53, a water droplet falls down due to its self-weight. Therefore, a hole for draining water is provided on the bottom of the duct 53. For example, a non-contact portion is provided between the duct member 54 and the inside surface of the engine cover body 15 in the position corresponding to the bottom of the duct 53. The water dropping from the bottom of the duct 53 is discharged to the outside through a drain hole (not shown) provided in the lower cover 2*a*.

While various embodiments of the present invention have been described and illustrated hereinbefore, they are just intended to show specific examples of the present invention. It would be appreciated that various changes, modifications, and alterations may be possible without departing from the scope and spirit of the present invention, and they should be also construed as being within the scope of the present invention.

According to the present invention, it is possible to provide an outboard motor having a water separation capability considering a measure for small-sized water drops such as a splash of water or mist as well.

What is claimed is:

1. An outboard motor comprising:

a combustion air intake port provided in an engine cover that covers an engine unit as an internal combustion engine; and a water separator configured to separate water from combustion air received from the combustion air intake port, wherein the combustion air received from the combustion air intake port is guided to the engine unit through the water separator, the combustion air intake port is provided in a side face of an upper part of the engine cover, and the water separator has an outer louver disposed to confront the combustion air intake port and an inner louver disposed inward of the outer louver at a predetermined interval to face the outer louver, wherein the combustion air received from the combustion on air intake port is guided to the engine unit through the inner louver after going through the outer louver.

2. The outboard motor according to claim 1, wherein the outer louver is a vertical louver provided with slats having a longitudinal direction arranged in a vertical direction, and the slat of the outer louver has a surface sloped forward and outward at a position confronting the combustion air intake port.

3. The outboard motor according to claim 2, wherein the slat of the outer louver has a V-shape in a cross-sectional plan view.

4. The outboard motor according to claim 1, wherein the inner louver is a vertical louver provided with slats having a longitudinal direction arranged in a vertical direction, and the slat of the inner louver has a surface sloped forward and outward at a position confronting the outer louver.

5. The outboard motor according to claim 4, wherein the slat of the inner louver has a V-shape in a cross-sectional plan view.

6. The outboard motor according to claim 4, wherein a gutter-like return section is provided in the slat of the inner louver.

7. The outboard motor according to claim 1, wherein the combustion air intake port is opened on an outer surface of the engine cover, the outer louver is placed inward of the combustion air intake port, and the engine cover is provided with at least one of a hood portion disposed to overlap with an upper part of the outer louver as seen in a side view and a wall portion disposed to overlap with a lower part of the outer louver as seen in a side view.

8. The outboard motor according to claim 1, wherein the engine cover includes an engine cover body and a top cover detachably mounted to an upper part of the engine cover body, and the outer and inner louvers are disposed inward of the top cover.

9. The outboard motor according to claim 8, wherein the inner louver is placed on a ceiling surface of the engine cover body, the ceiling surface is provided with a guide hole serving as an inlet of a combustion air passage, and the inner louver is formed in a ring shape as seen in a top plan view to surround the guide hole.

10. The outboard motor according to claim 9, wherein the outer louver is supported by a frame having a ceiling surface that blocks an upper opening of the ring-shaped inner louver and is disposed to face a side face of the inner louver.

11. The outboard motor according to claim 8, wherein a ceiling surface of the engine cover body has a center portion swelling upward and a trench formed in a lateral side of the center portion, the inner louver is disposed in the center portion, and the outer louver is disposed over the trench.

12. The outboard motor according to claim 11, wherein a gap is provided between a lower end of the outer louver and a bottom surface of the trench.

13. The outboard motor according to claim 11, wherein the bottom surface of the trench is a slope surface, so that water on the trench flows along the bottom surface and is discharged to the outside of the outboard motor.

14. The outboard motor according to claim 1, wherein the inner louver is disposed to be biased upward relative to the outer louver.

15. The outboard motor according to claim 1, wherein a ventilation air inlet duct is provided in one of left and right side faces of an upper part of the engine cover, a ventilation air outlet duct is provided in the other side face of the upper part of the engine cover, both the ventilation air inlet duct and the ventilation air outlet duct are disposed forward side with respect to the combustion air intake port.

* * * * *